US005776377A

United States Patent [19]

Hammel, Jr.

[11] Patent Number: 5,776,377

[45] Date of Patent: Jul. 7, 1998

[54] METERING BLOCK FOR CARBURETORS

[75] Inventor: Louis E. Hammel, Jr., Fontana, Calif.

[73] Assignee: Blythe International Marketing, Inc., Las Vegas, Nev.

[21] Appl. No.: 713,173

[22] Filed: Sep. 12, 1996

[51] Int. Cl.[6] ..... F02M 7/02; F02M 7/18

[52] U.S. Cl. ..... 261/23.2; 261/34.1; 261/121.3

[58] Field of Search ..... 261/34.1, 23.2, 261/121.3

[56] References Cited

U.S. PATENT DOCUMENTS

| | | | |
|---|---|---|---|
| 2,029,666 | 2/1936 | Markwart | 261/121.3 |
| 2,080,569 | 5/1937 | Hulley | 261/121.3 |
| 2,140,948 | 12/1938 | Baker | 261/121.3 |
| 2,273,979 | 2/1942 | Mock | 261/121.3 |
| 4,100,663 | 7/1978 | Crum | 261/34.1 |
| 4,229,384 | 10/1980 | Karino et al. | 261/121.3 |
| 4,277,423 | 7/1981 | Noguez | 261/34.1 |
| 4,556,032 | 12/1985 | Miller | 261/34.1 |
| 5,283,011 | 2/1994 | McClintic et al. | 261/34.1 |
| 5,591,383 | 1/1997 | Krup | 261/121.3 |

*Primary Examiner*—Tim R. Miles
*Attorney, Agent, or Firm*—Lyon & Lyon LLP

[57] ABSTRACT

A metering block having at least one removable jet cartridge is provided for replacing the physical and functional operation of the standard metering block for use with the carburetor and fuel bowl of a conventional internal combustion engine. The metering block has openings in the top of the block at an angle from vertical for receiving the jet cartridges. The jet cartridge is configured to utilize the standard fuel jets used with the standard metering block to maintain the same fuel metering characteristics as the standard metering block. The jet cartridge is positioned at an angle within the metering block to allow the jet cartridge and fuel jet to be removed and replaced from the carburetor without the need to remove the fuel bowl or metering block from the carburetor or fuel to be drained to obtain access to the fuel jet as is the case in the standard metering block design.

8 Claims, 10 Drawing Sheets

METERING BLOCK FOR CARBURETORS

FIELD OF THE INVENTION

The present invention pertains to carburetors for use in internal combustion engines. More specifically, the present invention pertains to a metering block assembly that includes one or more removable fuel jet cartridges for use as a replacement to the metering block and jet assemblies found in conventional carburetors that permits the fuel jets to be rapidly removed and changed without requiring the removal of the metering block or fuel bowl from the carburetor or fuel to be drained while maintaining the same fuel metering characteristics of the original carburetor fuel delivery mechanism.

In the past, carburetors have been provided for delivering a predetermined, calibrated mixture of air and fuel into the intake manifold of an internal combustion engine. Fuel that is to be mixed with air and delivered through the carburetor to the engine is typically introduced into a reservoir known as a fuel bowl and metered directly into the intake manifold of the engine through one or more orifices, known as fuel jets or just jets, mounted in the carburetor. The diameter of the orifice in the fuel jets controls the amount of fuel that may be metered into the engine under a given set of operating characteristics. Because of this, fuel jets are frequently changed to jets having different size orifices to recalibrate the air to fuel ratio of the engine to achieve specific performance goals. Thus, the orifice diameter of the fuel jets is an important factor to be taken into account when "designing or setting up" a carburetor for a given application.

In order to change the jets in existing carburetors, such as those manufactured by Holley® Corporation, for example, it has been necessary to physically remove the fuel reservoir or float bowl to gain access to the jets so that they can be removed and changed to the desired jet configuration. However, before the fuel reservoir can be removed, it is necessary to somehow drain the float bowl or allow the fuel contained in the fuel bowl to simply escape when the bowl is removed from the carburetor. Because carburetors are typically mounted on top of the engine, fuel escaping from the carburetor onto the engine creates a fire hazard, especially when the engine is hot. Because of this, removal of the float bowl from a carburetor in a hot engine creates a significantly hazardous situation, both for the mechanic and those in the surrounding area. Another difficulty associated with the removal of the float bowl is that such removal often damages a gasket provided between the fuel bowl and the mating structure of the carburetor, typically a metering block in Holley® designed carburetors, such that the seal or gasket must be replaced prior to reassembly of the float bowl to the carburetor.

In certain automotive applications, such as racing for example, it is important to be able to rapidly change the jets within the carburetor to fine tune the engine performance for the particular application. With regard to racing applications, variations in track conditions and atmospheric conditions, such as humidity and barometric pressure for example, make it desirable to have the ability to rapidly gain access to the carburetor jets to change them to jets that are appropriate for the particular track and atmospheric conditions. For example, during qualifying for a race, mechanics will typically fine tune the engine to achieve the optimal performance and thus achieve the fastest qualifying time by changing the fuel jets until the optimum engine performance is obtained. The dynamic nature of such a qualifying session demands that jet changes be performed rapidly in order to get the car back on the track as soon as possible. Moreover, during actual racing situations, it is frequently desirable to have the ability to affect rapid jet changes to compensate for changing track and atmospheric conditions or for other performance related reasons, such as fuel economy, for example.

Attempting to change the fuel jets under the demanding circumstances of prerace qualifying and actual racing situations has not been entirely successful because of the safety hazards associated with the removal of the fuel bowl from the carburetor to access the metering jets, as well as the time involved in physical removal and replacement of the fuel bowl. Even assuming that the gasket does not have to be replaced after removal of the fuel bowl, it still takes a significant amount of time to physically unbolt the fuel bowl and change the metering jets. This amount of time can be critical in qualifying and actual race situations. Holley® has produced an alternative style of float bowl for its carburetors that contains two screw-in plugs which are aligned with a vertical center line of each of the two jets associated with the primary and secondary venturies in its four-barrel carburetor design. The removable screw-in plugs allow access to the jets as they are retained in their normal position in the metering block without removing the float bowl. However, a special tool is required to hold the jet while it is being retrieved from the cavity of the float bowl, and if the special tool does not positively hold the jet while it is being retrieved, the jet will fall into the float bowl cavity. When this happens, the float bowl must be removed to obtain the jet. Moreover, the screw-in plug arrangement for accessing the jets still requires the fuel to be drained from the float bowl before the plug is removed; otherwise, the potential hazard of flammability remains.

Accordingly, it would be desirable to provide a system whereby the fuel jets could be readily removed from the carburetor assembly without the need to drain the carburetor or remove the fuel bowl to effect the change. It would be particularly desirable if the metering jets could be provided in a removable jet cartridge within a metering block that would replace the original equipment metering block provided on carburetors such as those designed by Holley® Corporation, for example, to permit rapid jet removal and replacement in those applications, particularly racing, that require rapid change-outs.

The function of the metering block in a typical Holley® carburetor is to control the amount of fuel which is delivered to an internal combustion engine by limiting fuel volume through a series of replaceable and nonreplaceable orifices. The replaceable orifices are commonly known as jets. Jets typically have a portion of machine screw threads on one end and a slotted configuration on the other end to facilitate removal and installation with a standard flat blade screwdriver. The jets are identified by the diameter of the orifice contained therein. A person using a Holley® carburetor would commonly change these jets to change the amount of fuel consumed by an internal combustion engine.

Fuel that is metered by the jets is introduced into a vertical chamber that is cast into the metering block. This chamber is commonly known as the main well. Fuel entering the main well enters at the bottom where the jets are located. As previously mentioned, the jets are retained in the metering block by their machine screw threads, and are exposed to a fuel supply contained within a float bowl or a fuel bowl. Under operating conditions, the fuel bowl contains a small reservoir of fuel which is maintained and made available to the jets under normal atmospheric pressure and gravity.

There is also a float control valve typically contained within the fuel bowl which allows the fuel entering the fuel bowl to be maintained at a relatively constant level within the bowl.

After fuel has passed through the jets and into the main well, a metered amount of air is introduced into the main well to mix with the fuel. This process of introducing air into the fuel is commonly referred to as "emulsion." As this process takes place, the fuel in the main well that is emulsified travels vertically upward until it reaches the height of a main well discharge passage, which is typically located near the top of the metering block. At this point, the emulsified fuel mixture exits the metering block and enters a passage commonly referred to as the main discharge nozzle where it enters and mixes with the air being consumed by the engine.

The entire mechanism for metering, emulsifying, and delivering of fuel to the carburetor's main discharge nozzle exists in a pair of identical mirror image configurations for two and four venturi carburetor applications. The venturies associated with a carburetor are commonly referred to as barrels such that a four venturi carburetor is referred to as a four-barrel carburetor. The metering blocks are configured to work in conjunction with two venturis at once. Thus, a two-barrel carburetor requires one metering block, whereas a four-barrel carburetor requires two metering blocks.

It is important to note that the emulsion process that takes place in a Holley® metering block configuration is controlled by a group of two or three holes per main well. The holes typically range in diameter from 0.028" to 0.040" and are formed integrally with the metering block casting, which is to say that they are drilled into the casting. To change the size of these holes requires that they be enlarged through drilling or reduced by the installation of a bushing. The metering block must be removed from the carburetor assembly to accomplish this procedure.

There are two ancillary fuel circuits contained within the metering block that operate with, but are separate from, the fuel well. The first of these circuits, the idle circuit, controls the fuel consumed by the engine during closed throttle periods. The other circuit is known as the power enrichment circuit and supplies additional fuel to the well during periods of maximum throttle opening when the greatest amount of work is being produced by the engine. A device known as a "power valve" is installed in the center of the metering block. This device employs a flexible diaphragm which is articulated by changes in pressure within the engine's intake manifold to open or close a passage in the metering block that controls the amount of additional fuel enrichment required by the engine. Power valves are available in different calibration levels. The difference being the amount of pressure required to open the power valve. The volume of enrichment fuel is controlled by the diameter of the passage drilled into the metering block which communicates with the additional fuel introduced by the power valve into the main fuel well.

SUMMARY OF THE INVENTION

According to the present invention, a replacement metering block and one or more removable jet cartridges which are inserted into the metering block are provided.

In a preferred embodiment, a metering block assembly directly replaces the physical and functional operation of the existing metering block in a carburetor, such as the carburetors offered by Holley® Corporation that incorporate fuel metering jets into the metering block. In a particularly innovative aspect, the metering block of the present invention is provided with one or more openings that receive unique removable jet cartridges which are received in openings in the top of the block at a predetermined angle containing conventional carburetor jets to facilitate removal and replacement of the jets from the carburetor without the need to remove the fuel bowl to obtain access to the jets as is the case in a conventional design.

In a particularly innovative aspect of the present invention, the metering block is provided with bores machined into the top of the block at an angle from vertical. The cartridge is positioned within the metering block so as to allow its removal without removing the float bowl and without draining the fuel from the float bowl. A unique benefit of the present invention is that the jets can be changed quickly, safely, and without turning off the engine and interrupting the fuel supply, if necessary for rapid change-out.

In another aspect of the invention, the orifices that controls the emulsion characteristics in a conventional metering block are provided as part of the removable jet cartridge design, rather than being part of the metering block itself. The significance of incorporating the emulsion orifices within the design of the jet cartridge is that the emulsion characteristics of the carburetor can be changed simply by changing the cartridges rather than the entire metering block.

Advantageously, the metering block of the present invention preferably employ the same gaskets, jets, power valves, and idle mixture control screws as are utilized in a production metering block. The benefit of this feature to the user of the metering block of the present invention is that it is not necessary to replace all the normal consumables, e.g., gaskets, required for normal service and/or period cleaning and inspection. Nor it is necessary to require a new assortment of calibration orifices, (e.g., jets, power valves) for the purpose of calibration changes.

The present invention provides a direct replacement metering block for the conventional metering block provided in a Holley® carburetor and through the use of removable jet cartridges permits the user to rapidly remove the jet cartridges using conventional tools to obtain access to the fuel metering orifice without the need to remove the fuel bowl and run the risk of spilling fuel on a hot engine. Particular utility of the present invention is found in applications where it is desirable to change jets rapidly and safely in response to dynamically changing track and atmospheric conditions in racing applications, for example. By utilizing the metering block and removable jet cartridges of the present invention, it is possible to change jet cartridges during the time associated with making a pit-stop to take on fuel and perform other maintenance activities normally associated with a pit-stop.

In yet another aspect of the invention, a quick release mechanism is provided for an air cleaner assembly that is typically mounted on top of the carburetor assembly to permit the air cleaner assembly to be quickly removed from the carburetor to permit access to the metering jets.

DETAILED DESCRIPTION OF A PREFERRED EMBODIMENT

Figure 1:
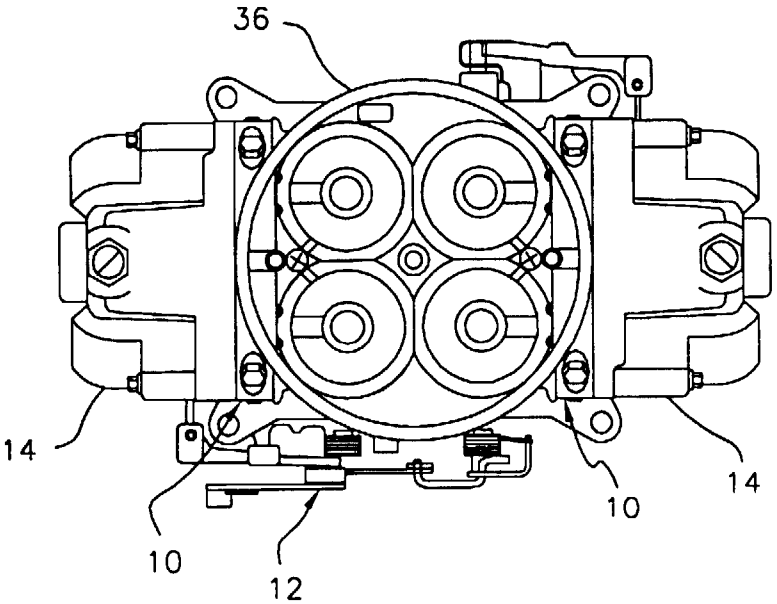
FIG. 1 is a plan view of an assembly including a carburetor, metering blocks and fuel bowls in accordance with a preferred embodiment of the present invention.

Referring now to the figures, FIG. 1 shows a metering block 10 according to a preferred embodiment of the present invention assembled to a standard four-barrel carburetor 12 having four venturis 16. A standard fuel bowl 14 is attached to the metering block 10. (The term "standard" as used herein to describe certain components, such as "standard carburetor," "standard fuel jets," "standard metering block," etc., means those components made or supplied by or for the original carburetor manufacturers.) For a four-barrel carburetor 12, the left side and right side of the carburetor will preferably have identical metering block 10 and fuel bowl 14 assemblies as shown in FIG. 1. The fuel bowl 14 contains a small reservoir of fuel to supply the metering block 10. A float controlled valve (not shown) within the fuel bowl 14 allows fuel to enter the fuel bowl 14 to maintain a relatively constant fuel level within the fuel bowl 14.

The metering block 10 is configured to work in conjunction with two venturis 16 at once. Thus, there are two metering blocks 10 in a complete assembly for the four-barrel carburetor 12 as shown in FIG. 1, one metering block 10 on each side of the carburetor 12. Each metering block 10 includes a configuration of fuel and air passages and orifices making up fuel and air circuits. The circuits of the left side and right side of the metering block 10 are mirror images of each other, except for an accelerator pump fuel circuit and a vacuum passage described below. Each mirror image configuration operates independently of the other to provide fuel to its respective venturi 16.

Figure 2:
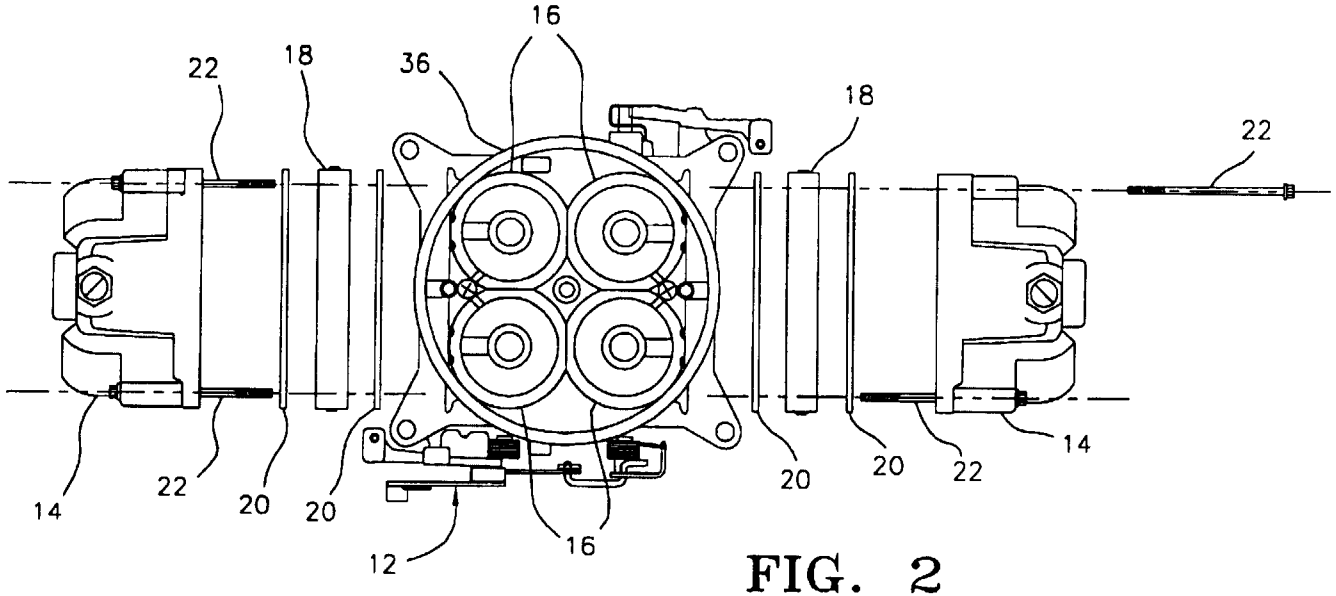
FIG. 2 is an exploded view of an assembly including a carburetor, standard metering blocks, and fuel bowls.
Figure 3:
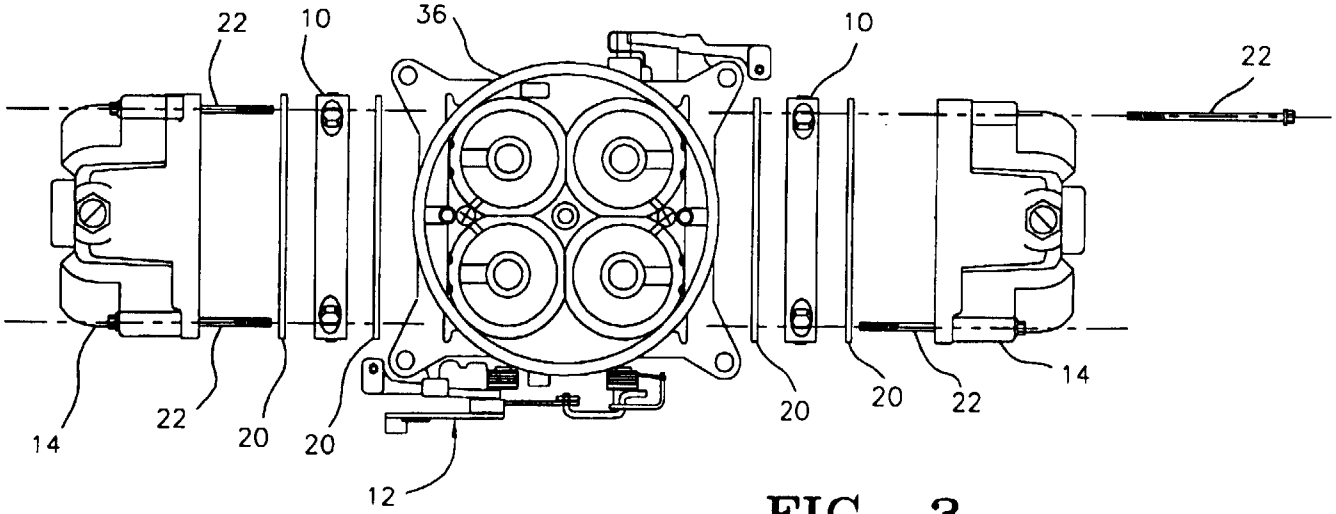
FIG. 3 is an exploded view of an assembly including a carburetor, metering blocks and fuel bowls in accordance with a preferred embodiment of the present invention.

FIG. 2 is an exploded view of an assembly including a carburetor 12, a pair of standard metering blocks 18, a pair of standard fuel bowls 14, and sealing gaskets 20 between each of the parts of the assembly. The assembly is fastened together using bolts 22. By comparison, FIG. 3 shows an exploded view of an assembly including a carburetor, a pair of metering blocks in accordance with a preferred embodiment of the present invention, a pair of fuel bowls 14 and sealing gaskets 20. The metering block 10 is configured to have substantially the same peripheral physical dimensions and features as the standard metering block 18 such that the metering block 10 of the present invention may directly replace the standard metering block 18 without any additional or modified parts or any modifications of the standard carburetor 12 and fuel bowl 14. Thus, the standard design bolts 22, gaskets 20, and fuel line assembly (not shown) for use with the standard carburetor assembly may be used with the metering block 10 of the present invention.

Figure 4:
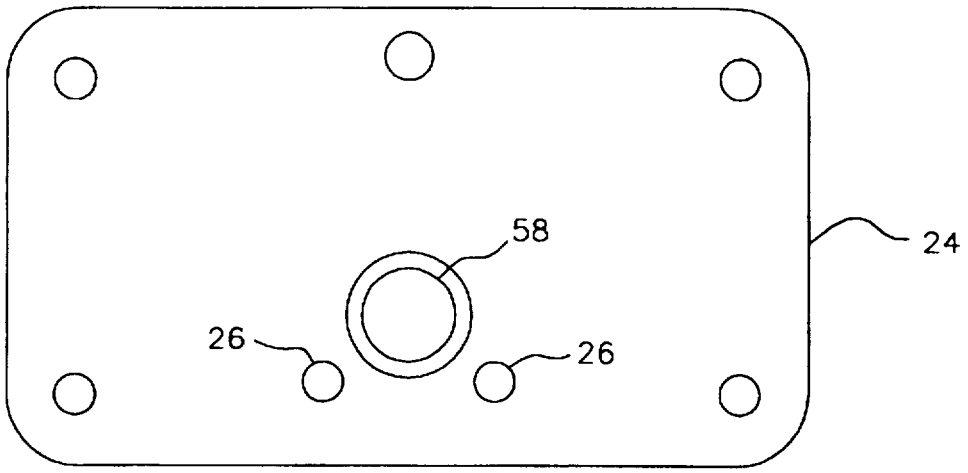
FIG. 4 is an elevational view of the front side of a metering block in accordance with a preferred embodiment of the present invention.
Figure 5A:
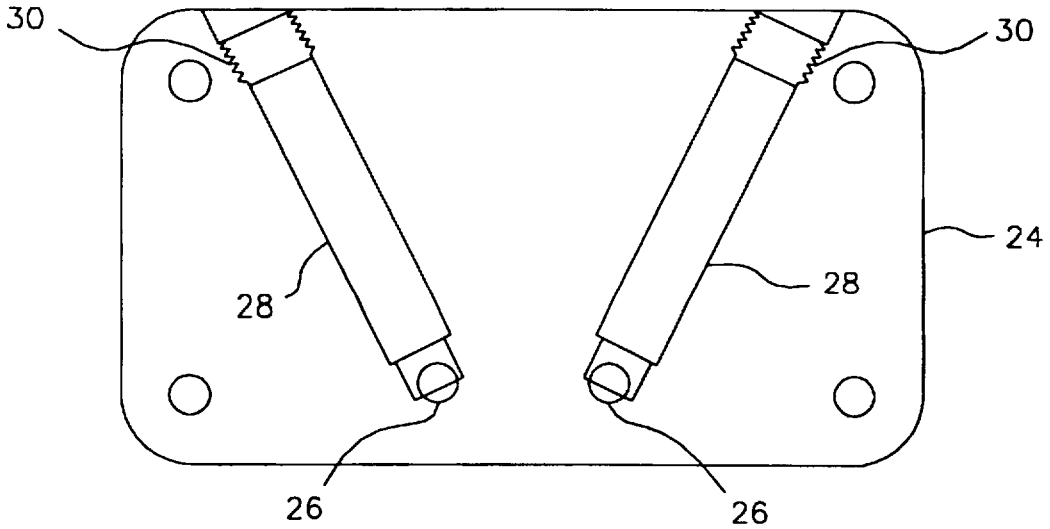
FIG. 5*a* is a sectional view along line 5*a*—5*a* of FIG. 5.
Figure 5:
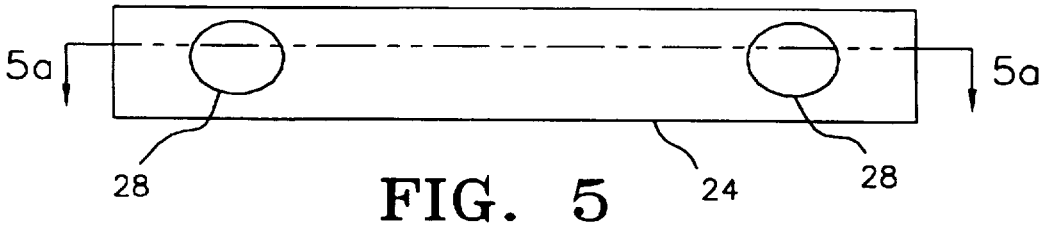
FIG. 5 is a plan view of the metering block.
Figure 11:
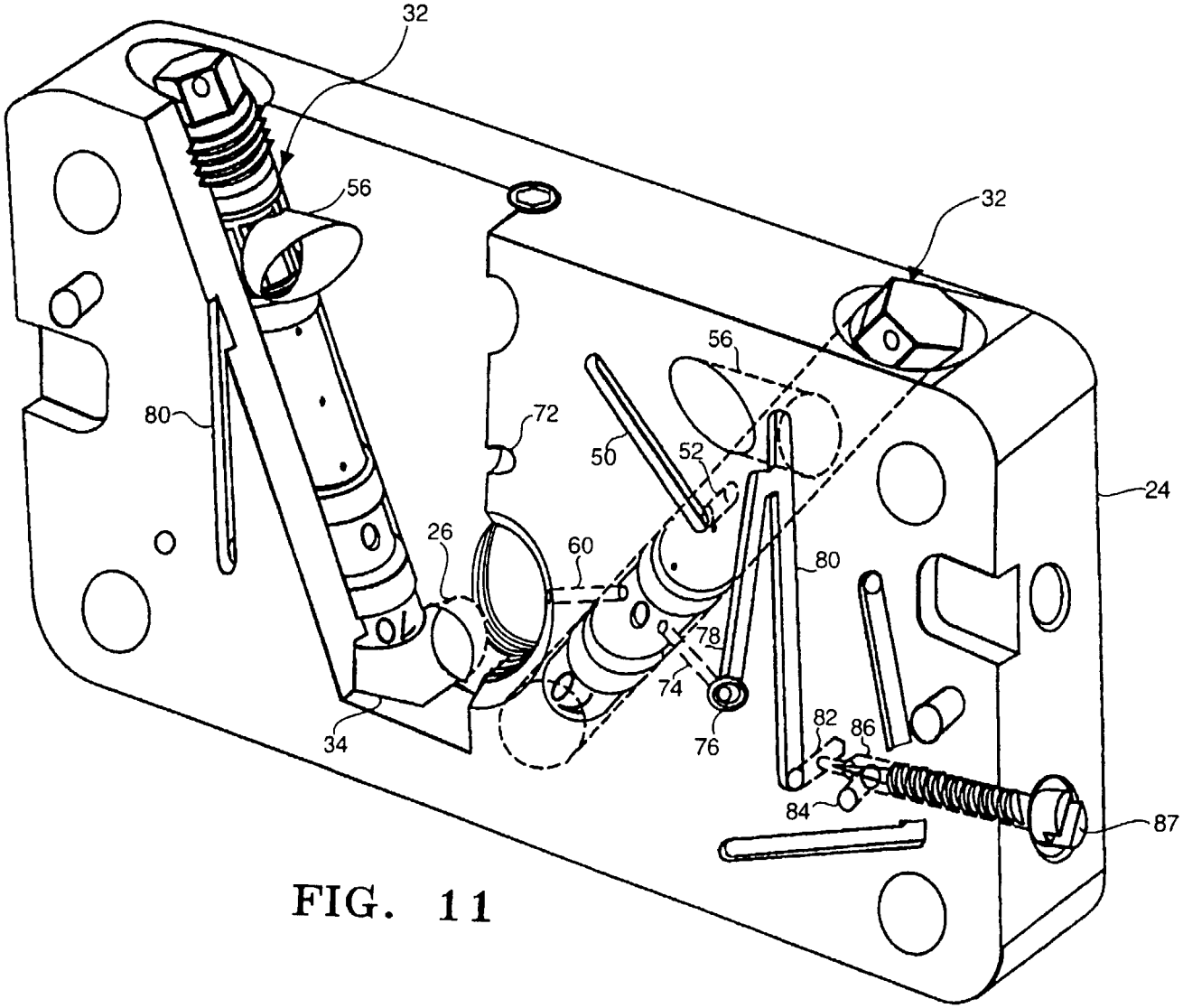
FIG. 11 is a cutaway view of a metering block in accordance with a preferred embodiment of the present invention.

Turning now to FIGS. 4, 5, and 11 in a preferred embodiment, the metering block 10 is manufactured starting with a metal billet, such as aluminum. The billet is machined to provide the necessary passages, orifices, and shapes to fit and function like the standard metering block 18 which it is designed to replace. Those skilled in the art will appreciate that other suitable materials, such as steel, alloys, etc., and other manufacturing techniques, such as casting, may be used to manufacture the metering block 10 without departing from the present invention. As discussed above, the left and right side of the metering block 10 are mirror images of each other, except for the accelerator pump fuel circuit and vacuum passage, and therefore, the following description of the left side will serve as a description of the right side. The corresponding elements on each side of the metering block 10 are referred to by like reference numbers throughout the drawings and description.

Figure 6:
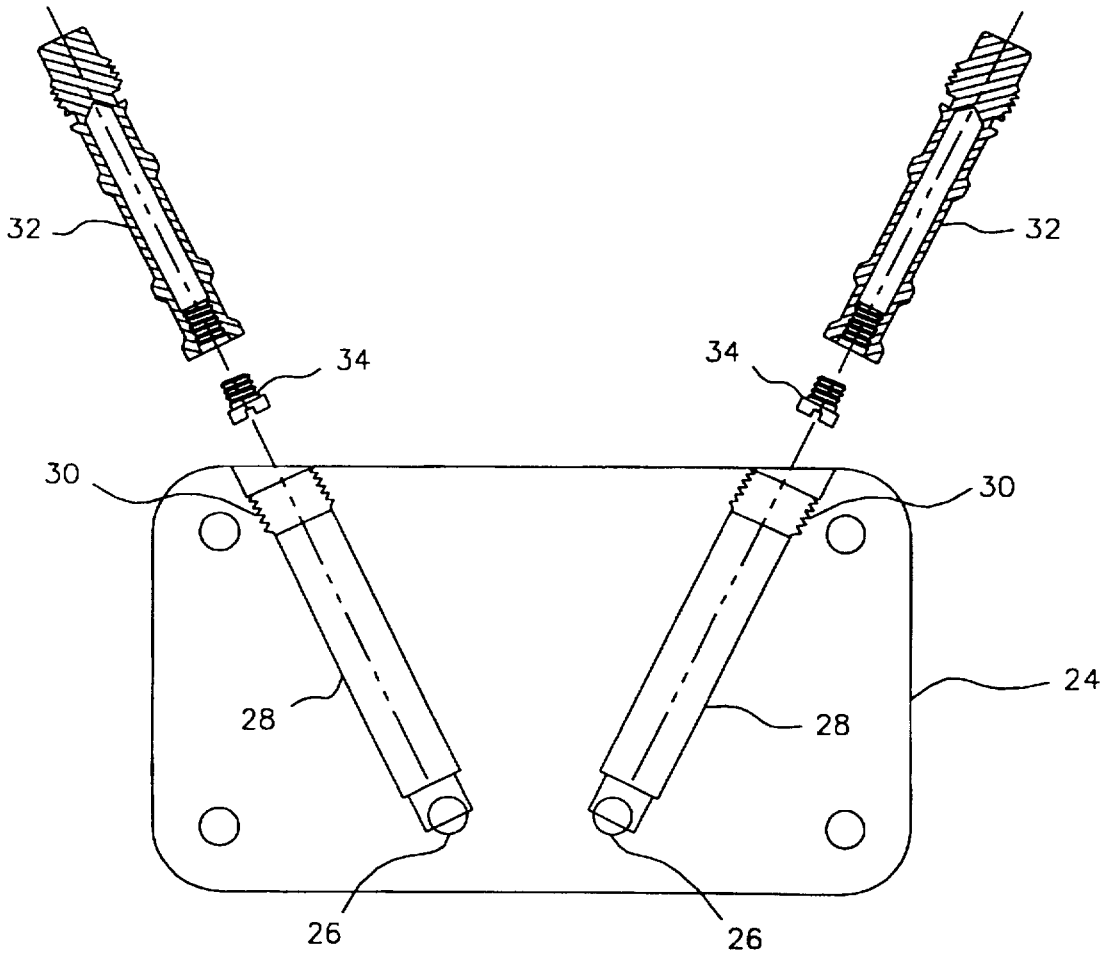
FIG. 6 is an exploded view of a fuel jet and jet cartridge assembly removed from the metering block.

Beginning with FIG. 4, the main fuel circuit of the metering block 10 will be described. FIG. 4 is an elevational view of the float bowl side, or front side, of the metering block 10. The metering block 10 includes a main body 24 having substantially the same physical dimensions, e.g. width, height, and thickness, as a standard metering block 18. The main body 24 has a fuel inlet 26 which is located below the normal fuel level within the fuel bowl 14. Fuel from the fuel bowl 14 enters the metering block 10 through the fuel inlet 26 and is drawn into the bottom of a main fuel well 28, shown in FIG. 6.

The main fuel well 28 is formed from a bore machined into the top of the body 24 at an angle of thirty degrees from vertical. The main well 28 has a threaded portion 30 at the top portion of the main well 28. The main well 28 receives a uniquely designed jet cartridge 32 and a fuel jet 34 attached to the bottom of the jet cartridge 32, shown in FIG. 6. The angle and position of the jet cartridge 32 and fuel jet 34 assembly installed main well 28 allows the jet cartridge 32 and fuel jet 34 assembly to be removed from the metering block 10 without having to remove the fuel bowl 14 from the metering block 10, the metering block 14 from the carburetor 12, or the carburetor 12 from the engine manifold (not shown). Moreover, as can be seen in FIG. 1, the angle of the jet cartridge 32 and fuel jet assembly 32 permits the assembly to be removed with clearance to get by the air cleaner support 36 of the carburetor 12. The jet cartridge 32 preferably has a hexagon bolt head machined into it near the top of the cartridge 32 to accept a standard socket tool (not shown) for installing and removing the jet cartridge 32 from the main well 28. Alternatively, the jet cartridge 32 may be provided with any other suitable fitting which allows one to install and remove the jet cartridge 32, such as a screw head, a wing-type fitting for installation by hand, a cap screw, etc.

Figure 7:
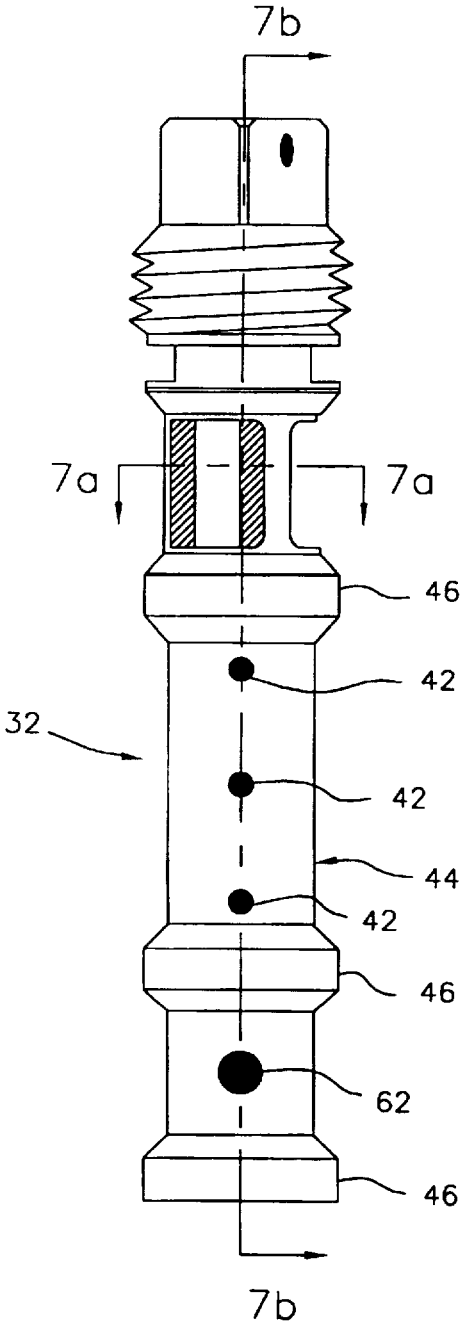
FIG. 7 is a jet cartridge in accordance with a preferred embodiment of the present invention.
Figure 7A:
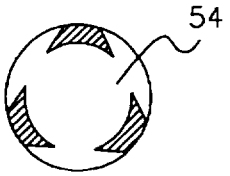
FIG. 7*a* is a sectional view along line 7*a*—7*a* of FIG. 7.
Figure 7B:
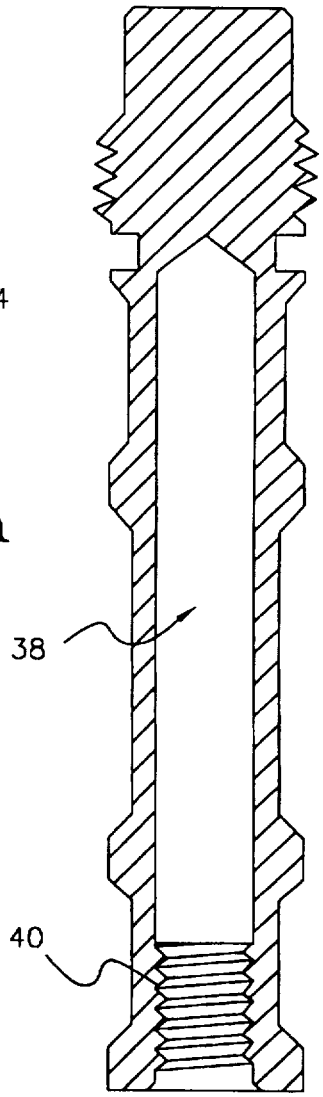
FIG. 7*b* is a sectional view along line 7*b*—7*b* of FIG. 7.

Fuel entering the bottom of the main well 28 then enters the fuel jet 34 which is attached to jet cartridge 32. The fuel jet 32 is preferably the standard fuel jets utilized in the standard metering block 18. This is advantageous because it is not necessary to furnish a new assortment of fuel jets having various calibrations and, importantly, the familiar and known calibration schemes and resulting performance characteristics achieved with the standard fuel jets are substantially duplicated. Thus, mechanics and others having experience and familiarity with the standard fuel jets may apply their experience with the standard jets directly to calibrating the metering block 10 of the present invention without having to experiment or calculate the characteristics of a new set of fuel jets. The jet cartridge 32, shown in FIG. 7, FIG. 7*a*, and FIG. 7*b* has an internal axial bore 38. The internal axial bore 38 has a threaded bottom portion 40 for receiving the fuel jet 34. The fuel passes through the fuel jet 34 and into the internal bore 38 of the jet cartridge 32.

As the fuel travels up the jet cartridge 32, the fuel enters an emulsion section 44 which is provided as part of the jet cartridge 32. The emulsion section 44 comprises calibrated orifices 42 in a reduced diameter portion of the body of the jet cartridge 24. The reduced diameter portion of the body is bounded at the top and bottom by sealing lands 46 which fit closely to the bore of the main fuel well 28 to seal the emulsion section 44 from the rest of the main fuel well 28. Those skilled in the art will recognize that the size, location and number of orifices may be varied to change the emulsion characteristics of the metering block 10.

Figure 8:
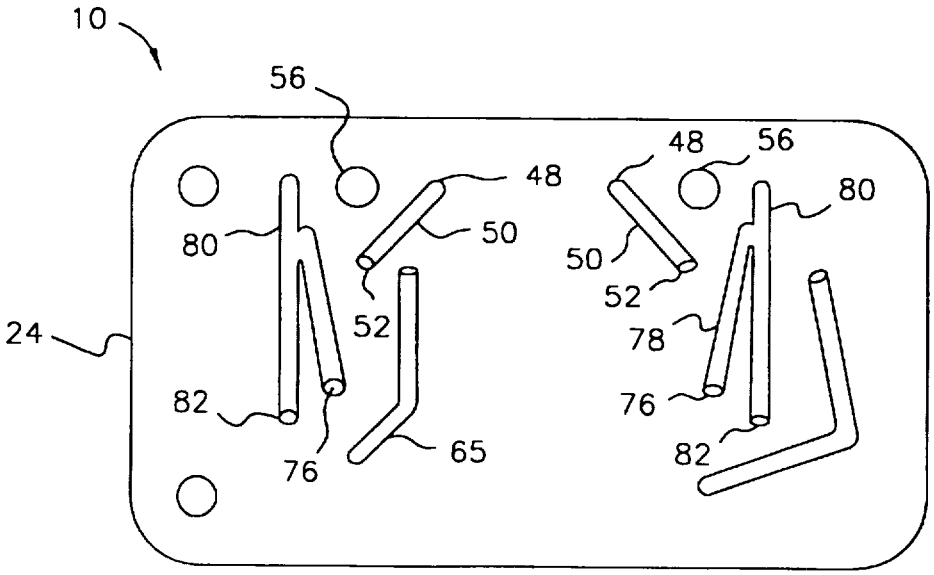
FIG. 8 is an elevational view of the back side of a metering block.

FIG. 8 shows the carburetor side or back side of the metering block 10. A high speed air bleed of the carburetor provides air through an orifice (not shown) in the carburetor which enters the metering block 10 at the top end 48 of air channel 50. The air passes through air channel 50 and through passage 52 connected to the main well 28. The channels shown in FIG. 8 are milled into the carburetor side of the metering block 10. The circles at the end of the channels depict an intersection of a channel with a drilled passage. From the main well 28, the air passes through the orifices 42 in the jet cartridge 32 and the air mixes with the fuel. The air-fuel mixture travels to the top portion of the jet cartridge 32, out of the jet cartridge 32 through openings 54 (FIGS. 7 and 7*a*) and then out through fuel outlet to the carburetor 12.

Figure 9:
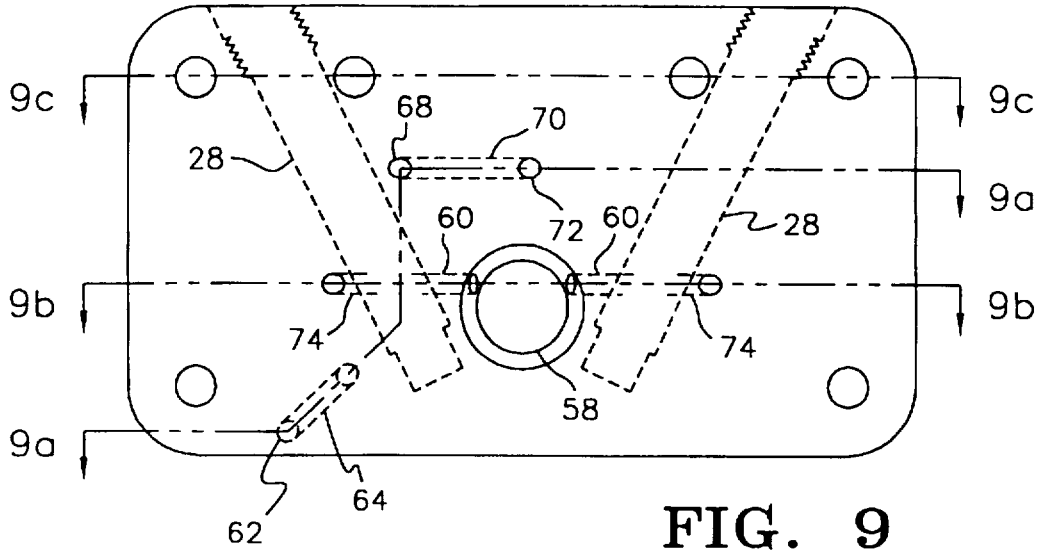
FIG. 9 is an elevational view of the back side of the metering block which shows in phantom the internal fuel and air passages.
Figure 9A:
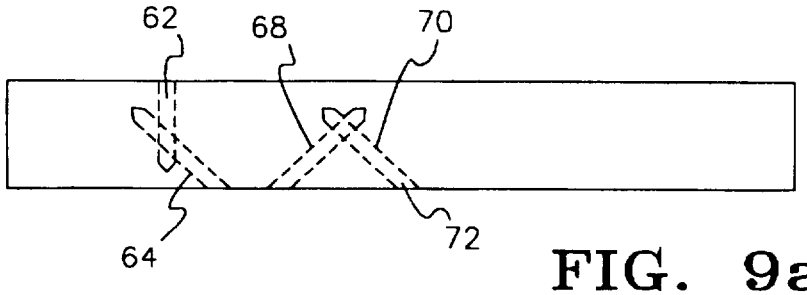
FIG. 9*a* is a sectional view along line 9*a*—9*a* of FIG. 9.
Figure 9B:
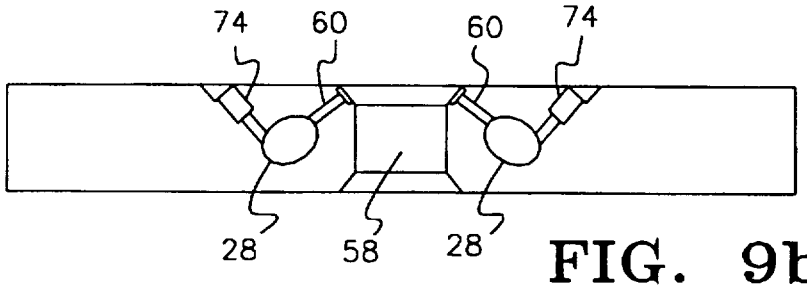
FIG. 9*b* is a sectional view along line 9*b*—9*b* of FIG. 9.
Figure 9C:
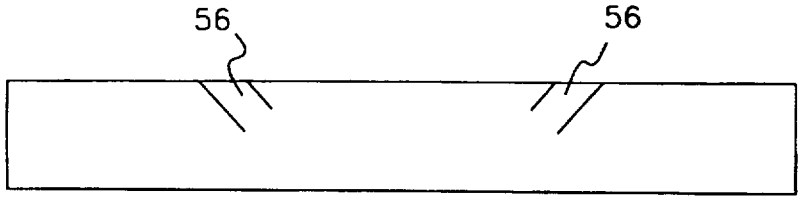
FIG. 9*c* is a sectional view along line 9*c*—9*c* of FIG. 9.

Fuel may also be introduced into the main fuel well 28 by the power enrichment circuit. The power enrichment circuit of the metering block 10 of the present invention is physically similar and functionally identical to the standard metering block 18. Referring to FIGS. 9*a*, 9*b*, and 9*c*, the power enrichment circuit includes an opening 58 through the metering block 10 which is threaded to receive a standard power valve (not shown). The power valve is typically a pressure-differential controlled valve which controls the flow of fuel from the fuel bowl 18 through the opening 58. When the power valve is opened, fuel can flow from the fuel bowl 18 through the passage 60 into the main fuel well 28, as best seen in FIG. 9*b*. This fuel passes through holes 62 (FIG. 7) in the side of a second reduced diameter portion of the jet cartridge 32 and is added to the amount of fuel passing though the main fuel jets 34 into the jet cartridge 32. The jet cartridge 32 has sealing lands 46 which bound the hole 62 in the jet cartridge 32 to seal the fuel entering the main fuel well 28 through opening 62 from the rest of the main fuel well 28.

The metering block 10 has an accelerator pump fuel circuit which does not have a mirror opposite pair. Referring to FIGS. 9, 9*a*, and 9*b*, fuel from an accelerator pump (not shown) of the fuel bowl 18 enters the metering block 10 through an opening 62 on the fuel bowl side (front side) of the metering block 10. The opening 62 is situated in the gasket area of the fuel bowl side of the metering block 10 as shown in FIG. 9. The fuel entering opening 62 passes through passage 64, through channel passage 65 (FIG. 8), through passages 68 and 70 and into the carburetor 12 through an opening 72.

Figure 10B:
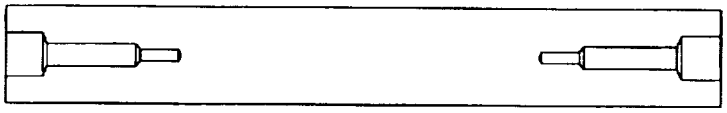
FIG. 10*b* is a sectional view along line 10*b*—10*b* of FIG. 10.
Figure 10:
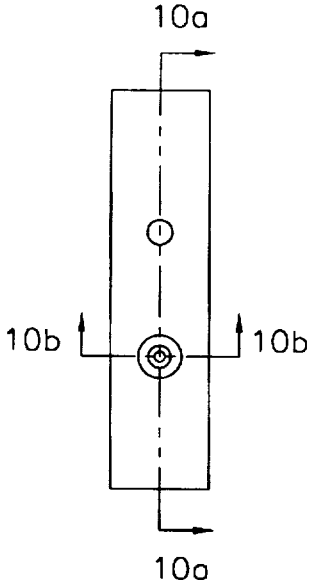
FIG. 10 is a side view of a metering block.
Figure 10A:
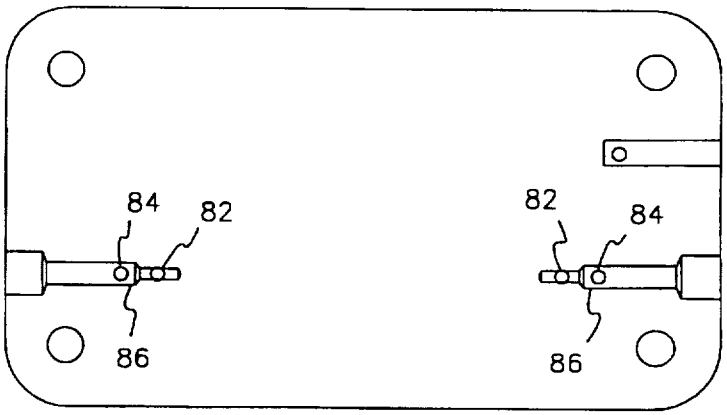
FIG. 10*a* is a sectional view along line 10*a*—10*a* of FIG. 10.

The idle fuel control circuit of the metering block 10 differs in location and physical dimensions from those in the standard metering block 18. Still, the idle control circuit of the metering block 10 is functionally identical to the standard metering block 18. Again, referring to FIGS. 9 and 9*b*, an idle fuel passage 74 is connected at one end to the main fuel well 28 and transfers fuel from the main fuel well 28 to an idle fuel feed jet 76 shown in FIG. 8. The fuel passes through the idle fuel feed jet 76 into the bottom of an idle fuel channel 78. The fuel flows up the idle fuel channel 78 to an idle bleed air channel 80. Air from an orifice (not shown) in the carburetor enters the idle bleed air channel 80 and mixes with the fuel in the idle fuel channel 80. The air-fuel mixture flows down the idle air-fuel channel 80 and through an opening 82 into the carburetor 12. As shown in FIG. 10, another discharge opening 84 into the carburetor 12 is provided which is fed by fuel flowing past the opening 82 and through a secondary idle passage 86, the flow being controlled by an idle adjustment screw 87 (FIG. 11) received in the idle passage 86.

Figure 12:
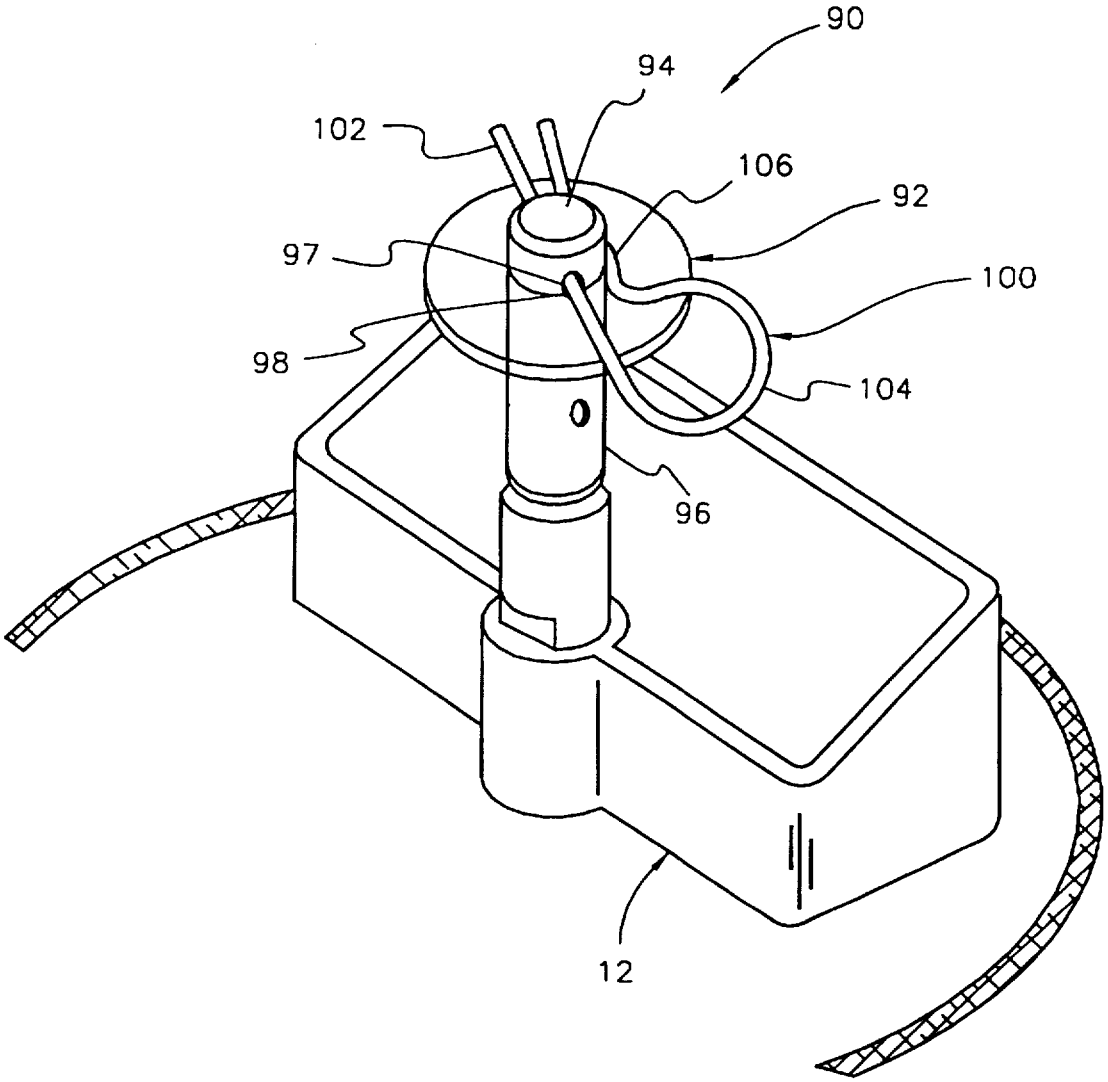
FIG. 12 is a perspective view of a quick release mechanism in accordance with a preferred embodiment of the present invention.

A quick release mechanism 90 for securing an air filter housing to the carburetor is shown in FIG. 12. The quick release mechanism 90 is intended to replace the standard arrangement which typically includes a threaded stud which receives a self-locking nut or wing nut. The quick release mechanism 90 complements the use of the metering block 10 of the present invention which allows quick and safe replacement of the jet fuel cartridges 32 and fuel jets 34. The air filter housing (not shown) sits above the carburetor and metering block such that the air filter housing must be removed in order to access the fuel jet cartridges 32. Hence, the quick release mechanism 90 speeds changing the fuel jet cartridges 32 and/or fuel jets 34 by providing a faster and easier method of removing and installing the air filter housing.

The quick release mechanism comprises a large flat washer 92 having a head portion 94 which fits onto a stud 96. The base of the stud 96 is fixed to the carburetor 12. The stud 96 has a hole (not shown) near the top of the stud 96. The head portion 94 of the washer 92 has a hole 98 which matches the hole 97 in the stud 96 when the washer 92 is installed. A clip 100 having a straight portion 102, a loop 104, and a locking portion 106. The locking portion 106 has an arcuate shape to fit around the head portion of the washer. The straight portion 102 of the clip 100 inserts into the holes 97 and 98 in the washer 92 and stud 96, respectively, to lock the washer onto the stud 96 thereby securing the air filter housing to the carburetor. The clip 100 is flexible so that when the locking portion 102 of the clip is placed around the head portion 94 of the washer 92, the clip 100 is in tension around the head portion 94. A tension spring (not shown) may also be employed between the stud 96 and the washer 92 to retain tension on the clip 100 to ensure that the clip 100 does not inadvertently come off. In another aspect of the invention, a cable (not shown) attaching the clip 100 to the air filter housing (not shown) may be utilized to retain the clip 100 while the clip is removed from the stud 96 to prevent the clip 100 from falling into the engine or from getting lost.

While the above description of a preferred embodiment contains many specifics, these should not be construed as limitations on the scope of the present invention, but rather as examples of particular embodiments thereof. Many other variations are possible.

Accordingly, the scope of the present invention should be determined not by the embodiments described herein, but by the appended claims and their legal equivalents.

What is claimed is:

1. A metering block assembly for use with a carburetor having a fuel bowl, the metering block assembly comprising:

a body having a bore in a top of said body at an angle from vertical, said bore forming a main fuel well; and a fuel jet cartridge removably received in said main fuel well, said fuel cartridge having a threaded hole adapted to engage a standard fuel jet, said fuel jet cartridge being removable from said body while the carburetor and the fuel bowl remain attached to the metering block assembly to allow replacement of said fuel jet cartridge and said fuel jet with a fuel cartridge and fuel jet having different performance characteristics.

2. The metering block assembly of claim 1 wherein said threaded hole in said fuel cartridge is adapted to engage a standard Holley® fuel jet.

3. The metering block assembly of claim 1 wherein said angle from vertical of said main fuel well is about thirty degrees.

4. The metering block assembly of claim 1 further comprising an accelerator pump fuel circuit which is functionally identical to a standard metering block.

5. A metering block body for use in a metering block assembly of a carburetor having a fuel body, the metering block body comprising:

a body having a bore in a top of said body at an angle from vertical, said bore forming a main fuel well, said main fuel well for removably receiving a fuel jet cartridge having a threaded hole adapted to engage a standard fuel jet while the carburetor and the fuel bowl remain attached to the metering block assembly to allow replacement of said fuel jet cartridge and said fuel jet with a fuel cartridge and fuel jet having different performance characteristics.

6. The metering block body of claim 5 wherein said threaded hole in said fuel cartridge is adapted to engage a standard Holley® fuel jet.

7. The metering block body of claim 5 wherein said angle from vertical of said main fuel well is about thirty degrees.

8. The metering block body of claim 5 further comprising an accelerator pump fuel circuit which is functionally identical to a standard metering block.

* * * * *